US006315155B1

(12) United States Patent
Hubanks et al.

(10) Patent No.: US 6,315,155 B1
(45) Date of Patent: Nov. 13, 2001

(54) FOLDED PAPER TOWEL DISPENSER

(75) Inventors: Brian D. Hubanks, Dousman; Paul A. Omdoll, Waukesha, both of WI (US)

(73) Assignee: The Coleman Group, Elkhorn, WI (US)

( * ) Notice: Subject to any disclaimer, the term of this patent is extended or adjusted under 35 U.S.C. 154(b) by 0 days.

(21) Appl. No.: 09/392,187

(22) Filed: Sep. 9, 1999

(51) Int. Cl.[7] ..... B65H 1/00; B65H 3/00; A47K 10/24

(52) U.S. Cl. ..... 221/63; 221/38; 221/41; 221/53

(58) Field of Search ..... 221/38, 41, 53, 221/63

(56) References Cited

U.S. PATENT DOCUMENTS 2,830,728 * 4/1958 Krueger et al. ..... 221/48
4,623,074 * 11/1986 Dearwester ..... 221/48 X
4,678,099 * 7/1987 Matsui ..... 221/48 X
4,938,382 * 7/1990 Frazier et al. ..... 221/63 X
5,074,430 * 12/1991 Roberts ..... 221/63 X
5,090,592 * 2/1992 Petterson et al. ..... 221/63 X
5,950,863 * 9/1999 Schutz et al. ..... 221/46 X
6,003,723 * 12/1999 Morand ..... 221/44 X

* cited by examiner

*Primary Examiner*—Christopher P. Ellis
*Assistant Examiner*—Gene O. Crawford
(74) *Attorney, Agent, or Firm*—Michael Best & Friedrich LLP

(57) ABSTRACT

The device for dispensing multi-fold paper towels has a housing for holding a generally vertical stack of the paper towels and including a lower portion through which individual towels can be dispensed from the stack. The lower portion includes an elongated opening through which a fold of the bottommost towel can extend and be accessible for a user to grab and pull the bottommost towel from the stack. One side portion of the towels rest on a plurality of laterally spaced ribs or ramps located in the vicinity of the front edge of the opening and inclined at an angle upwardly and forwardly relative to the front edge. These ribs or ramps effectively transfer a portion of the pressure applied by the stack on the bottommost towel toward the rear, thereby reducing the force required to pull the bottommost towel from the stack. The opening preferably is shaped to cause the fold of the bottommost towel to assume a C-like shape and thereby reduce the amount of the fold readily accessible to a user.

10 Claims, 4 Drawing Sheets

FOLDED PAPER TOWEL DISPENSER

BACKGROUND OF THE INVENTION

The invention relates to paper towel dispensers and, more particularly, to dispensers for multi-fold paper towels.

Dispensers for multi-fold paper towels typically include a housing or cabinet for storing a generally vertical stack of the paper towels and a slot-like opening in the bottom of the cabinet through which a user can pull the bottommost towel from the stack. The pressure applied to different parts of the bottommost towel tends to be uneven and a user can tear off only a portion of the towel flap, instead of the entire towel, particularly when his or her hands and thumbs are wet. In many cases, a relatively large portion of a fold is accessible to a user and he or she can grab the fold at any location along substantially the entire length. Consequently, the amount of force required to pull the bottommost towel from the stack varies significantly depending on the particular location the user grabs the fold and the direction he or she pulls on the fold. Also, there is a tendency for more than one towel to be pulled from the stack when the stack becomes quite small. These problems are particularly prevalent when more absorbent towels are being dispensed.

SUMMARY OF THE INVENTION

An object of the invention is to provide a device for dispensing multi-fold paper towels that is arranged to minimize the force required to pull the bottommost towel from a substantially vertical stack.

Another object of the invention is to provide such a device that is arranged to reduce the amount of a fold on the bottommost towel accessible for grabbing by a user.

A further object of the invention is to provide such a device that is arranged to present a fold of the bottommost towel in a configuration for facilitating grabbing the central portion of the fold by a user.

Other objects, aspects and advantages of the invention will become apparent to those skilled in the art upon reviewing the following detailed description, the drawings, and the appended claims.

The device for dispensing multi-fold paper towels provided by the invention includes a housing for holding a generally vertical stack of the paper towels and a lower portion through which individual towels are dispensed from the stack. The lower portion includes a front wall, rear wall, opposed side walls and a bottom wall. The paper towels are dispensed through an elongated opening in the bottom wall through which a fold of the bottommost towel in the stack can extend and be disposed in a position where a user can grab the fold and pull the bottommost towel from the stack. A plurality of laterally spaced ramps or ribs is located in the vicinity of one edge of the opening. These ribs have an inclined surface extending at an angle upwardly and in a direction away from that edge and are adapted to be engaged by and support one side portion of the towels with the other side portion supported adjacent of opposite wall of the bottom portion. These ribs transfer a portion of the pressure applied on the bottommost towel from the side portion supported on the ribs toward the other side portion, thereby reducing the force required to pull the bottommost towel from the stack. Likewise, triangular pads located on either end of the opening transfer a portion of the pressure applied on the bottommost towel from the end portions supported on the pads toward the opening, thereby reducing the force required to pull the bottommost towel from the stack.

One edge of the opening preferably is generally U-shaped and the other edge preferably is configured to cause the fold of the towel extending through the opening to assume a C-like shape.

Figure 1:
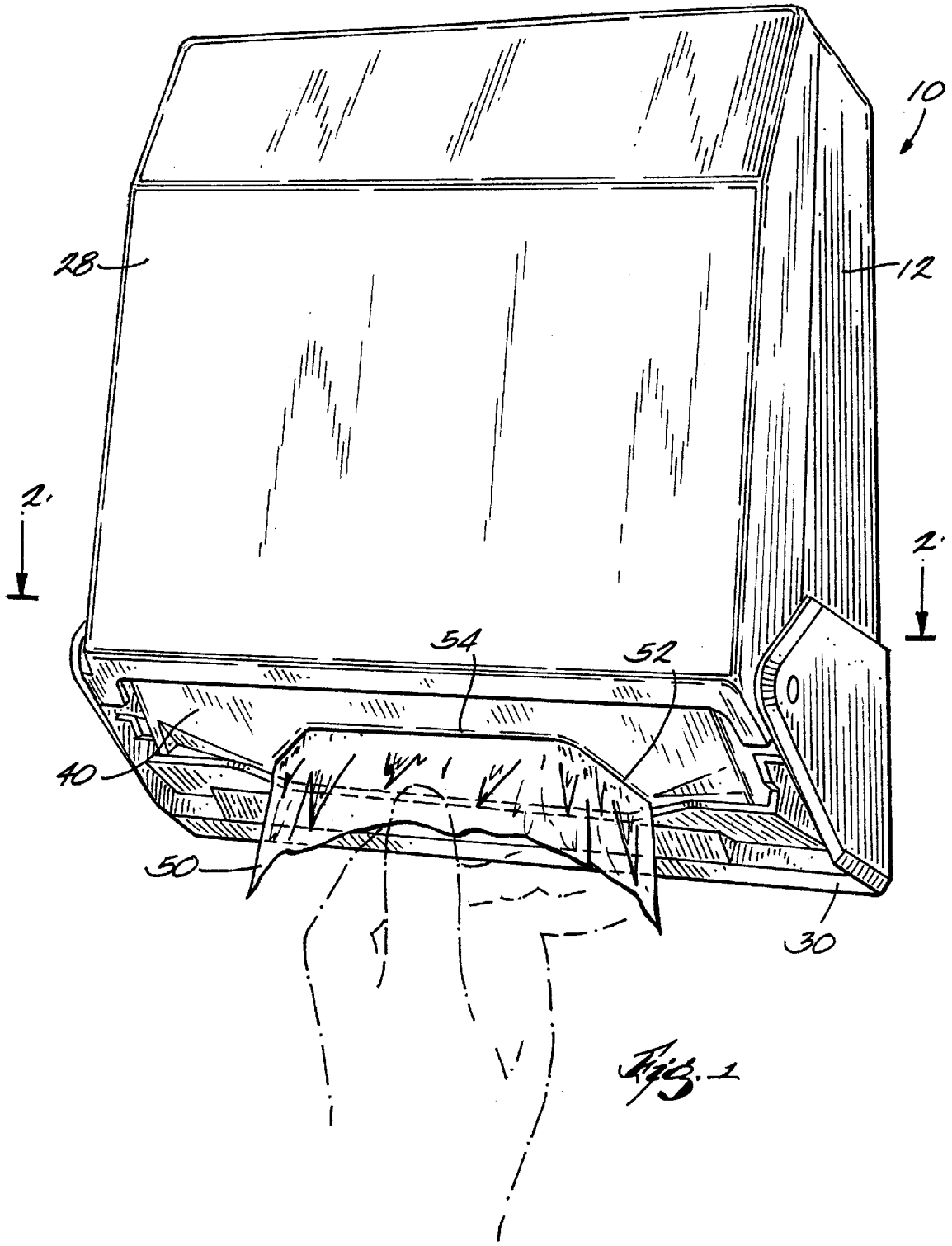
FIG. 1 is a perspective view of a multi-fold paper towel dispenser incorporating various features of the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify steps of a method or process is simply for identification and is not meant to indicate that the steps should be performed in a particular order.

DESCRIPTION OF PREFERRED EMBODIMENTS

The drawings illustrate a dispenser 10 for multi-fold paper towels incorporating various features of the invention. The dispenser 10 includes a housing or cabinet 12 having an internal chamber 14 for holding a generally vertically oriented stack 16 of elongated, generally rectangular multi-fold paper towels 18 having opposed side portions 20 and 22 and opposed end portions 24.

The cabinet 12 has a pivotally mounted front door 28 which can be swung down to gain access to the chamber 14 and a lower portion 30 from which individual paper towels can be dispensed from the stack.

Figure 2:
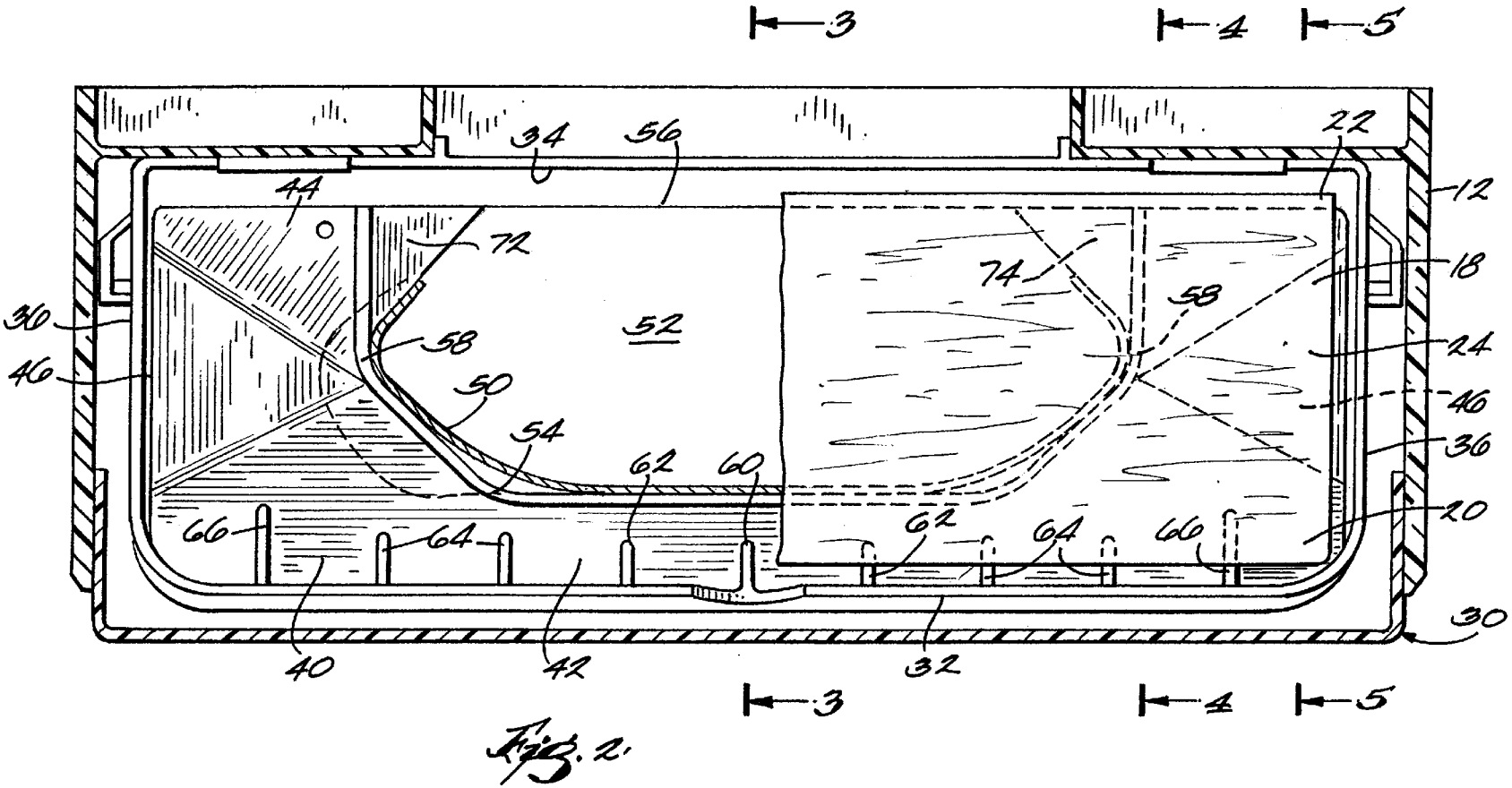
FIG. 2 is a plan sectional view taken generally along line 2—2 in FIG. 1 with a portion of the paper towels broken away to clarify the illustration of the bottom portion of the dispenser.

As best illustrated in FIG. 2, the lower portion 30 of the cabinet 12 includes a front wall 32, a rear wall 34, opposed side walls 36 and a bottom wall 40. The bottom wall 40 has a front portion 42, a rear portion 44 and opposed side pads 46. Each opposed side pad 46 is triangular in shape when viewed from above, with the base of the triangle coincident with an opposed side wall 36, and the apex of the triangle meeting the opening 52 adjacent to opposed end edge 58. Each opposed side pad 46 slopes downwardly from its base to its apex.

Located in the front portion 42 of the bottom wall 40 is an elongated dispenser opening 52, having a length and width smaller than that of the paper towels 18, through which a fold 50 of the bottommost towel extends and is ready for a user to grab and pull the bottommost towel from the stack 16. The dispensing opening 52 has a front side edge 54, a rear side edge 56 and opposed end edges 58 spaced inwardly from respective of the side walls 36. The front edge 54 preferably has a generally U-shape as illustrated in FIG. 2 for reasons explained in more detail below.

In accordance with the invention, the lower portion 30 of the cabinet 12 is arranged to reduce the force required for a user to pull the bottommost towel 18 from the stack 16 and yet permit the stack 16 to apply sufficient pressure on the next towel to prevent it from being pulled from the stack 16 along with the bottommost towel. In the specific embodiment illustrated, this is accomplished in part by two methods.

Figure 3:
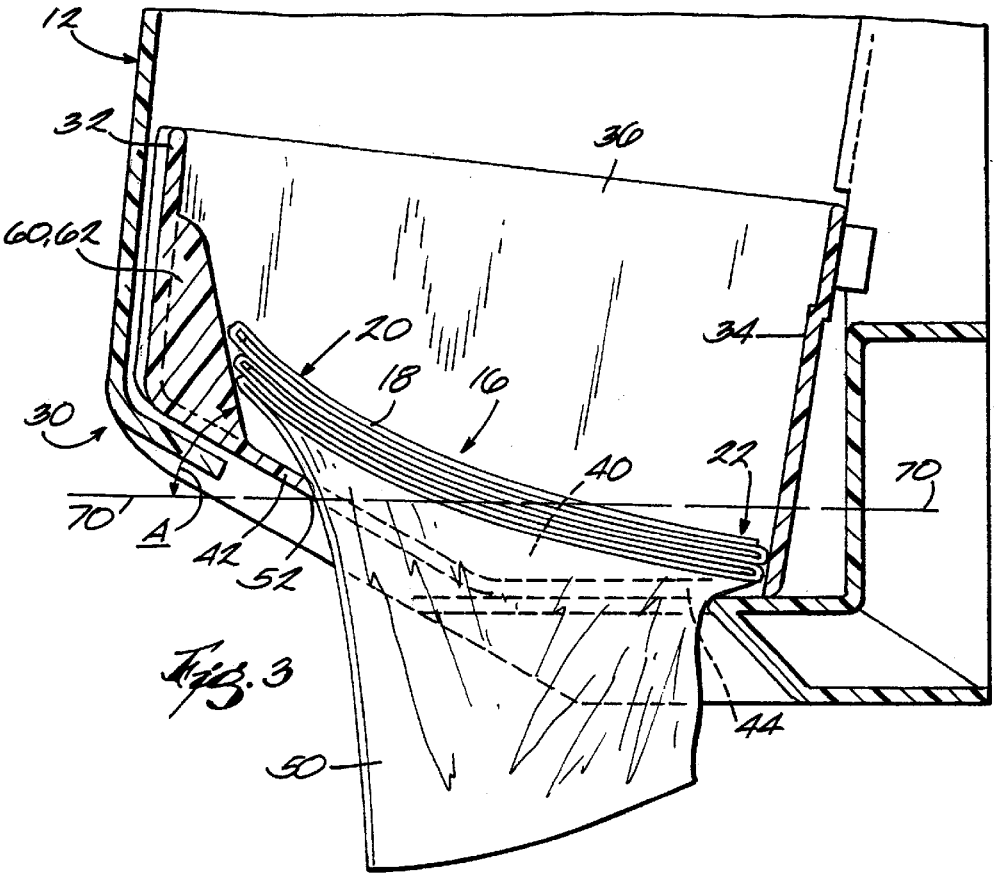
FIG. 3 is a fragmentary cross sectional view taken generally along line 3—3 in FIG. 2.
Figure 4:
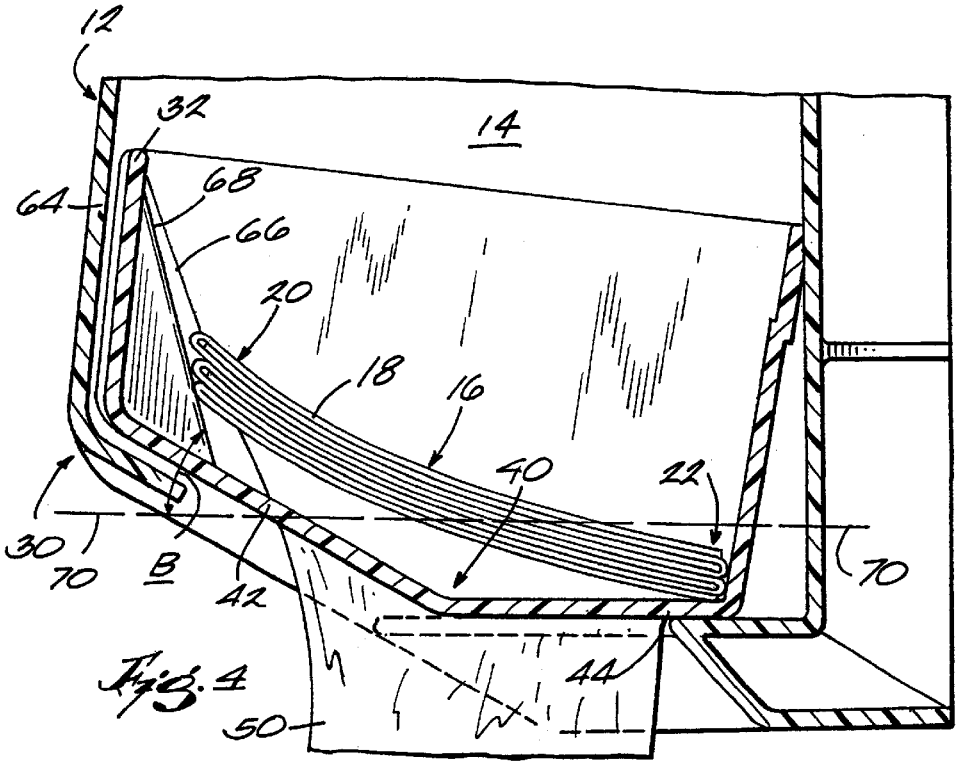
FIG. 4 is a fragmentary cross sectional view taken generally along line 4—4 in FIG. 2.

First, pressure is reduced by providing a plurality of laterally spaced ribs or ramps 60, 62, 64 and 66 located in front of the front edge 54 of the opening 52 and extending upwardly from the front portion 42 of the bottom wall 40. Each of these ramps has an inclined surface 68 extending in a direction upwardly and away from the front edge 54 of the opening 52. That is, as viewed in FIGS. 3–5, the inclined surfaces 68 extend toward the front wall 32 at an acute angle relative to a horizontal plane 70 extending through the front edge 54 of the opening 52.

One side portion 20 of the bottommost towel 18 is supported on the inclined surfaces 68 of the ramps and the other side portion 22 rests on the rear portion 44 of the bottom wall 40 adjacent the rear wall 34. The ramps effectively transfer a portion of the pressure applied on the bottommost towel from the side portion 20 to the rear portion 22, thereby reducing the force required for a user to pull the bottommost towel 18 from the stack 16.

The ramps 60, 62, 64, and 66 preferably are arranged to also transfer the pressure applied on the bottommost towel in a direction away from the center. Stated differently, the ramps 60, 62, 64, and 66 impact curvature in the stack of towels between side portions 20 and 22 to relieve the stack weight pressure in the direction from side portion 20 to side portion 22. This is accomplished by progressively decreasing the acute angle of the inclined surfaces 68 in a direction away from the centrally located ramp 60. For example, in the specific embodiment illustrated in FIG. 3, the angle A of the inclined surfaces for the center ramp 60 and the two adjacent ramps 62 are the same and can be about 76.5°, the angle B of the inclined surfaces 68 for the ramps 64 are the same and can be about 75° and the angle C of the inclined surfaces 68 for the ramps 66 are the same and can be about 69.5°. The inclined surfaces 68 cause the side portion 20 of the towels 18 and the stack to assume an arcuate shape, i.e. a generally concave shape like that illustrated by the dashed line in FIG. 2.

Figure 5:
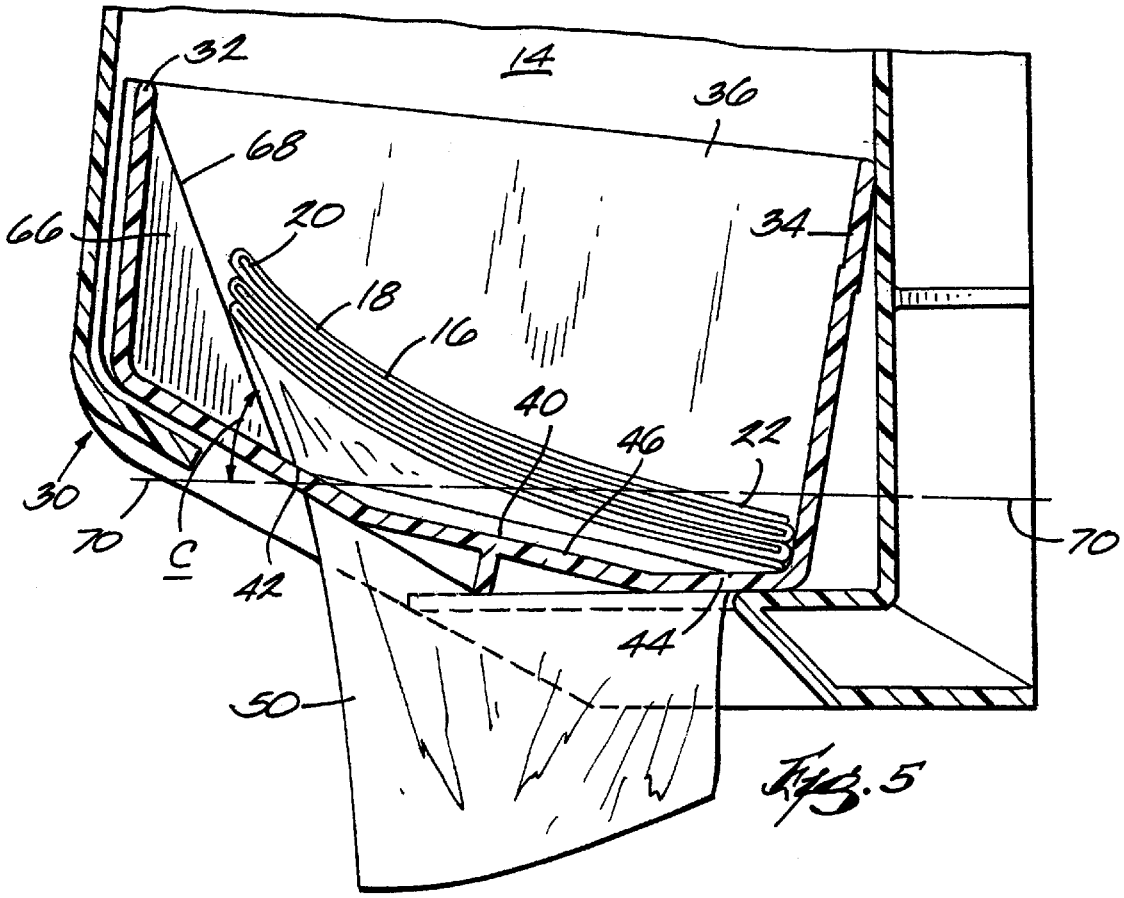
FIG. 5 is a fragmentary cross section view taken generally along line 5—5 in FIG. 2.
Figure 6:
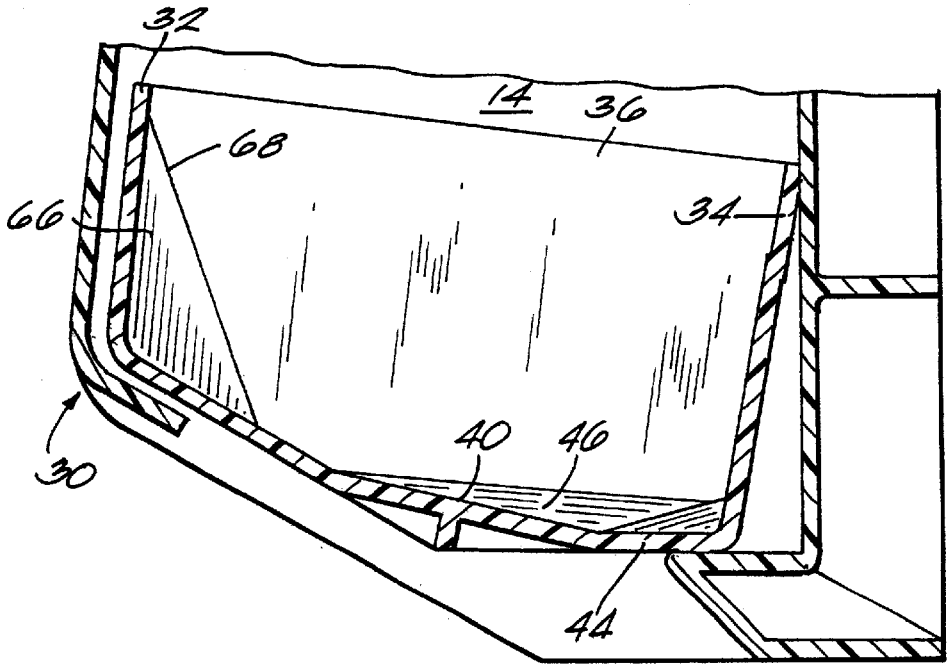
FIG. 6 is the same view as FIG. 5 but without paper towels present.

A second method used to reduce the force required for a user to pull the bottommost towel 18 from the stack 16 and yet permit the stack 16 to apply sufficient pressure on the next towel to prevent it from being pulled from the stack 16 along with the bottommost towel employs the opposed side pads 46. Stated differently, the pads 46 impact curvature in the stack of towels between opposed end portions 24 to relieve the stack weight pressure in the direction between the end portions 24. The downward slope of the triangular shape of each opposed side pad 46, as illustrated in FIGS. 5 and 6, transfers the pressure applied on the bottommost towel in a direction away from opposed end portions 24 of the towel and toward the opening 52. The inclined opposed side pads 46 cause the opposed end portions 24 of the towels 18 and the stack to assume an arcuate shape, i.e., a generally concave shape. The opposed side pads 46 prevent a towel 18 from hanging up when being pulled from the stack 16.

In operation, a user pulls the exposed towel from the opening 52. Because the folds of the towels are intertwined, the flap or fold of the next towel to be distributed is pulled down through the opening 52. Because of the curvature imparted to the stack of towels by both the ramps 60, 62, 64, and 66, and the pads 46, the fibers of the flap of the paper towel are actually broken, causing the flap of the next towel to be distributed to retain a C-like shape. Moreover, the opening 52 is arranged to cause the flap 50 of the towel 18 next to the bottommost one to be "puffed", i.e. formed into a C-like shape as illustrated in FIGS. 1 and 2, as the bottommost towel is pulled from the stack. This encourages a user to grab the center of the flap 50 and pull from the center of the stack where the least pressure is applied. In the specific embodiment illustrated, this is accomplished by arranging the front edge 54 of the opening 52 to have a generally U-shape and providing the rear edge 56 of the opening 52 with opposite end portions 72 and 74 connected to the rear edge 56 and extending at an angle outwardly toward the opposite end edges 58 and in the direction of a respective side wall 36.

Various features and advantages of the invention are set forth in the following claims.

What is claimed is:

1. A device for dispensing generally rectangular multifold paper towels having opposed, longitudinally extending side portions and opposed end portions, said device comprising:

a housing defining a chamber for holding a generally vertical stack of the paper towels and including a lower portion through which individual towels can be dispensed from the stack, said lower portion including a front wall, rear wall, opposed side walls and a bottom wall having a front portion, a rear portion and opposed side portions, an elongated opening smaller than the paper towels in said bottom wall and through which a fold of the bottommost paper towel in the stack can extend and be disposed in a position where a user can grab such fold and pull the bottommost towel from the stack, said opening having a first side edge located in one of the front and rear portions of said bottom wall, a second side edge located in the other of the front and rear portions of said bottom wall and opposed end edges spaced inwardly from respective of said side walls, and a plurality of laterally spaced ribs located in the vicinity of said first side edge of said opening, each of said ribs having an inclined surface extending at an angle upwardly and in a direction away from said first side edge of said opening and adapted to be engaged by and support one side portion of the stack of paper towels with the other side portion of the paper towels supported on the other of the front and rear portions of said bottom wall and thereby transfer a portion of the pressure applied by the stack on the bottommost towel from the side portion supported on said ribs toward the other side portion, wherein at least one of said ribs is substantially centrally located relative to said first side edge of said opening and the angles of said inclined surfaces of other of said ribs located on opposite sides of said one rib progressively increase in a direction away from said one rib to cause the side portion of the towels supported on said ribs to assume an arcuate configuration and to distribute pressure applied by the stack on the bottommost towel in opposite directions away from said one rib.

2. A device according to claim 1, wherein the inclined surfaces of said ribs extend at an acute angle relative to a horizontal plane extending through said first side edge of said opening.

3. A device according to claim 2, wherein one of the front and rear portions of said bottom wall extends at an angle upwardly and in a direction away from the other of said front and rear portions of said bottom wall and said ribs are connected to said one portion of said bottom wall.

4. A device according to claim 3, wherein said first side edge of said opening is generally U-shaped.

5. A device according to claim 4, wherein said second side edge of said opening has a laterally extending central portion and end portions connected to respective ends of said central portion which extend at an angle inwardly toward said first side edge of said opening and outwardly toward respective said side walls of said bottom portion and cause the fold of the bottommost towel extending through said opening to assume a C-like shape.

6. A device for dispensing generally rectangular multifold paper towels having opposed, longitudinally extending side portions and opposed end portions, said device comprising:

a housing defining a chamber for holding a generally vertical stack of the paper towels and including a lower portion through which individual towels can be dispensed from the stack, said lower portion including a front wall, rear wall, opposed side walls and a bottom wall having a front portion, a rear portion and opposed side portions, an elongated opening smaller than the paper towels in said bottom wall and through which a fold of the bottommost paper towel in the stack can extend and be disposed in a position where a user can grab such fold and pull the bottommost towel from the stack, said opening having a front edge located in the front portion of said bottom wall, a rear edge located in the rear portions of said bottom wall and opposed end edges spaced inwardly from respective of said side walls, and a plurality of laterally spaced ribs located forwardly from said front edge of said opening, each of said ribs having an inclined surface extending upwardly and forwardly relative to said front edge at an acute angle relative to a horizontal plane extending through said front edge and adapted to be engaged by and support one side portion of a stack of paper towels with the other side portion of the paper towels supported on the rear portion of said bottom wall and thereby transfer a portion of the pressure applied by the stack on the bottommost towel from the side portion supported on said ribs towards the other side portion, at least one of said ribs being substantially centrally located relative to said front edge of said opening and the angles of said inclined surfaces of other of said ribs located on opposite sides of said one rib progressively increase in a direction away from said one rib to cause the side portion of the towels supported on said ribs to assume an arcuate configuration and to distribute pressure applied by the stack on the bottommost towel in opposite directions away from said one rib.

7. A device according to claim 6 wherein said front edge of said opening is generally U-shaped.

8. A device according to claim 7 wherein said rear edge of said opening has a laterally extending central portion and end portions connected to respective ends of said central portion which extend at an angle inwardly toward said first side edge of said opening and outwardly toward respective said side walls of said bottom portion and cause the fold of the bottommost towel extending through said opening to assume a C-like shape.

9. A device for dispensing generally rectangular multifold paper towels having opposed, longitudinally extending side portions and opposed end portions, said device comprising:

a housing defining a chamber for holding a generally vertical stack of the paper towels and including a lower portion through which individual towels can be dispensed from the stack, said lower portion including a bottom wall, an elongated opening in said bottom wall and through which a fold of the bottommost paper towel in the stack can extend and be disposed in a position where a user can grab such fold and pull the bottommost towel from the stack, said opening having a first side edge having a central portion relative to the housing; and a plurality of laterally spaced ribs located adjacent to said opening, each rib having an inclined surface extending at an acute angle relative to a horizontal plane, said ribs having decreased steepness with increased distance from the central portion of the first side edge to cause the side portion of the towels supported on said ribs to assume an arcuate configuration and to distribute pressure applied by the stack on the bottommost towel in opposite directions away from the central portion of the first side edge.

10. A device according to claim 9, further comprising at least one triangular-shaped pad located adjacent to the opening, having an inclined surface extending at an angle upwardly and in a direction away from the opening, and adapted to be engaged by and support one end portion of the stack of paper towels and thereby transfer a portion of the pressure applied by the stack on the bottommost towel from the end portion supported on said pad toward said opening, wherein the inclined surface of said pad extends at an acute angle relative to a horizontal plane.

* * * * *